US007475661B2

(12) United States Patent
Taye et al.

(10) Patent No.: US 7,475,661 B2
(45) Date of Patent: Jan. 13, 2009

(54) CAMSHAFT PHASER HAVING A DIFFERENTIAL BEVEL GEAR SYSTEM

(75) Inventors: Elias Taye, Macomb Township, MI (US); Thomas H. Lichti, Victor, NY (US); Daniel R. Cuatt, Rush, NY (US); Bruno Lequesne, Troy, MI (US)

(73) Assignee: Delphi Technologies, Inc., Troy, MI (US)

( * ) Notice: Subject to any disclaimer, the term of this patent is extended or adjusted under 35 U.S.C. 154(b) by 28 days.

(21) Appl. No.: 11/582,087

(22) Filed: Oct. 17, 2006

(65) Prior Publication Data

US 2008/0087241 A1 Apr. 17, 2008

(51) Int. Cl.
*F01L 1/34* (2006.01)

(52) U.S. Cl. ..... 123/90.17; 123/90.15; 74/640

(58) Field of Classification Search ..... 123/90.15, 123/90.16, 90.17, 90.18; 74/640
See application file for complete search history.

(56) References Cited

U.S. PATENT DOCUMENTS 5,680,836 A 10/1997 Pierik
5,680,837 A 10/1997 Pierik
6,457,446 B1 * 10/2002 Willmot ..... 123/90.17
6,543,399 B2 4/2003 Heer

FOREIGN PATENT DOCUMENTS

JP 7279632 10/1995

* cited by examiner

*Primary Examiner*—Ching Chang
(74) *Attorney, Agent, or Firm*—Thomas N. Twomey

(57) ABSTRACT

A camshaft phaser comprising a differential bevel gear arrangement to vary the phase relationship of a camshaft to a crankshaft in an internal combustion engine. In the differential gear system, a 45° beveled input gear is mounted parallel to and coaxial with a 45° beveled output gear. One or more 45° beveled spider gears is disposed in meshed relationship with the input and output gears in a gear pattern having a rectangular cross-sectional appearance. Rotation of the input gear causes an opposite rotation of the output gear. The phase relationship between the input and output gears may be varied by varying the position of the spider gear. The input gear and spider gears may be driven via a sprocket in time with the crankshaft in a plurality of arrangements.

15 Claims, 6 Drawing Sheets

CAMSHAFT PHASER HAVING A DIFFERENTIAL BEVEL GEAR SYSTEM

TECHNICAL FIELD

The present invention relates to a mechanism for varying the timing of combustion valves in internal combustion engines; more particularly, to camshaft phasers for varying the phase relationship between an engine's crankshaft and camshaft; and most particularly, to an oil-less camshaft phaser including a differential bevel gear drive.

BACKGROUND OF THE INVENTION

Camshaft phasers ("cam phasers") for varying the timing of combustion valves in an internal combustion engines are well known. A first element, known generally as a sprocket element, is driven by a chain, belt, or gearing from an engine's crankshaft. A second element is mounted to the end of an engine's camshaft, including intake or exhaust valve camshafts in engines having dual camshafts.

In the prior art, cam phasers typically employ one of two different arrangements for achieving variable valve timing.

In a first arrangement, the sprocket element is provided with a first cylinder having helical splines on its inner surface, and the camshaft element is provided with a second cylinder having helical splines on its outer surface. The first and second cylinders nest together. When one cylinder is driven axially of the other, the helical splines cause relative rotation there between, thereby changing the phase relationship. Typically, an axially-acting ram is controllably displaced by pressurized engine oil pirated from the engine oil supply system.

In a second arrangement, the sprocket element is provided with a stator having a central opening and having a plurality of lobes extending radially inward into the central opening and spaced apart angularly of the stator body. The camshaft element is provided with a rotor having hub and a plurality of outwardly extending vanes. When the rotor is installed into the stator, the vanes are disposed between the lobes, thereby defining a plurality of rotor-advancing chambers on first sides of the vanes and a plurality of rotor retarding chambers on the opposite sides of the vanes. Again, pressurized oil is controllably admitted to either the advance chambers or the retard chambers to selectively alter the phase angle between the crankshaft and the camshaft, thereby varying the timing of the engine valves.

While effective and relatively inexpensive, both types of prior art cam phasers suffer from several drawbacks.

First, at low engine speeds engine oil pressure tends to be low, and sometimes unacceptably so; therefore, the response of a conventional cam phaser is sluggish at low engine speeds.

Second, at low environmental temperatures, and especially at engine start-up, engine oil displays a relatively high viscosity and is more difficult to pump and to supply to a phaser in a rapid-response fashion.

Third, using engine oil to drive a phaser is parasitic on the engine oil system and can lead to requirement for a larger oil pump.

And finally, for fast actuation, a larger engine oil pump may be necessary, resulting in an additional energy drain on the engine.

What is needed in the art is a camshaft phaser wherein the phaser is not actuated by pressurized oil and therefore phaser performance is not subject to variation in engine oil pressure, temperature, or viscosity.

It is a principal object of the present invention to vary engine valve timing by varying camshaft phase angle without reliance on pressurized oil.

SUMMARY OF THE INVENTION

Briefly described, a camshaft phaser in accordance with the invention comprises a differential bevel gear arrangement to vary the phase relationship of a camshaft to a crankshaft in an internal combustion engine. As is known in the art of differential gearing, a 45° beveled input ring gear is mounted parallel to and coaxial with a 45° beveled output ring gear. One or more 45° beveled spider gears is disposed in meshed relationship with the input and output gears in a gear pattern having a rectangular cross-sectional appearance. Rotation of the input gear causes an opposite rotation of the output gear. The phase relationship between the input and output gears may be varied by varying the position of the spider gear.

In a series of embodiments, a plurality of spider gears are arranged on a spider gear carrier which is driven rotationally by an electric motor between the input and output gears to vary the relative angular positions of the spider gears and thus to vary the phase relationship of the input gear to the output gear. The driving means may be disposed outside the spider carrier or within the spider carrier. A preferred system for driving the spider gear carrier employs a worm gear drive to eliminate backlash from camshaft torque variations.

In a third embodiment, the sprocket wheel is a part of the spider gear carrier such that the crankshaft drives the spider gears, which are now input gears, and the phase of the previous input gear is changed by either a motor or a braking system to change the phase of the output gear.

BRIEF DESCRIPTION OF THE DRAWINGS

The present invention will now be described, by way of example, with reference to the accompanying drawings, in which.

The exemplifications set out herein illustrate currently preferred embodiments of the invention. Such exemplifications are not to be construed as limiting the scope of the invention in any manner.

DESCRIPTION OF THE PREFERRED EMBODIMENTS

Figure 1:
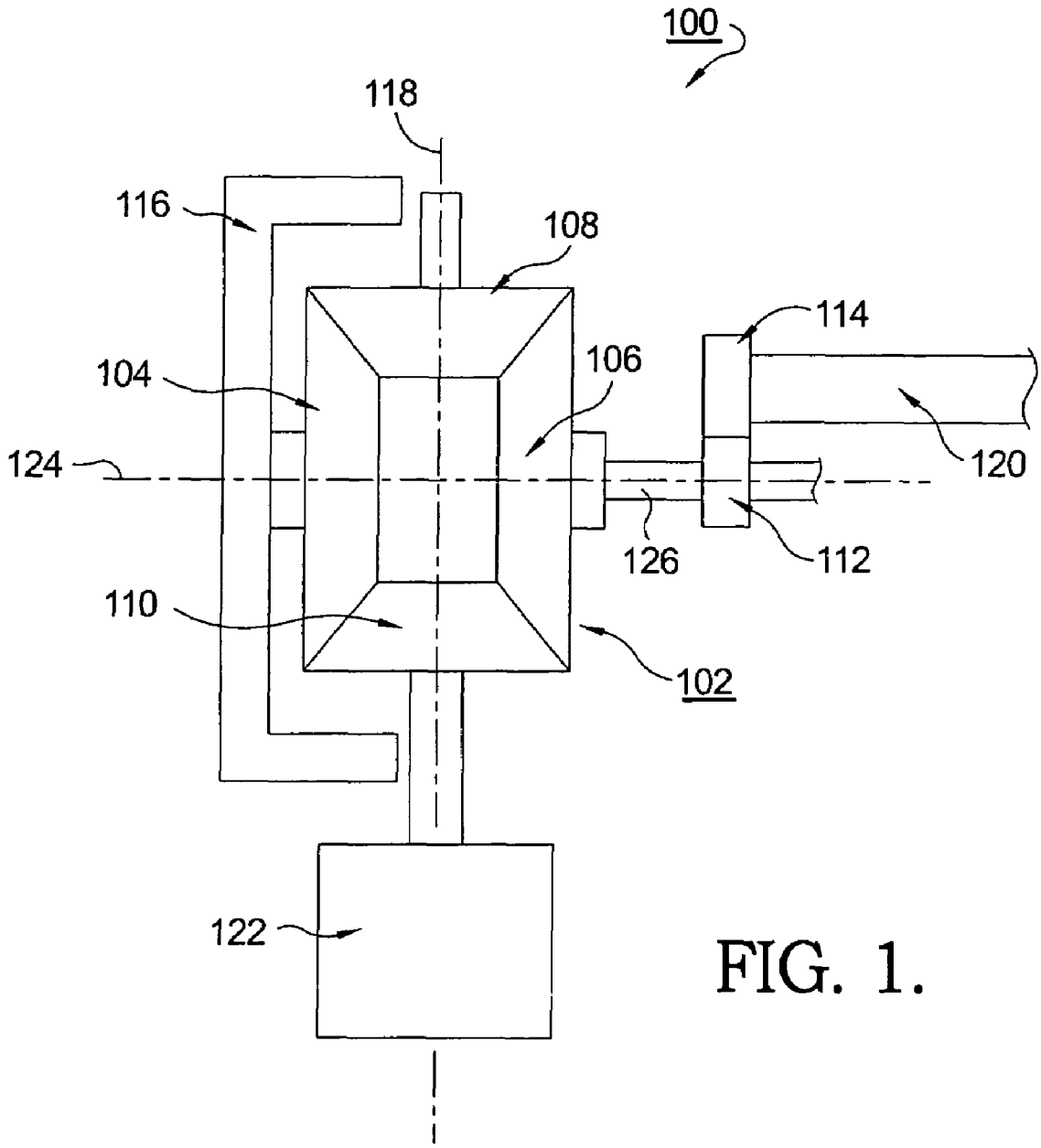
FIG. 1 is a schematic cross-sectional view of a bevel gear system.

To help understand the various embodiments of the present invention, referring to FIG. 1, gear mechanism 100 describes the general operation of a bevel gear system. The main components of this differential bevel gear system are first bevel (or ring) gear 104, second bevel (or ring) gear 106, spider bevel gear 108, control gear 110, and optional spur gears 112, 114. First gear 104 is an input bevel gear fixed to an input drive mechanism 116. First input bevel gear 104 is connected to second bevel gear 106 via spider gear 108. Spider gear 108 rotates on its own axis 118. Second bevel gear 106 is an output gear linked to a driven output shaft 120 through spur gears 112, 114. Control gear 110, which is linked to both input and output bevel gears 104, 106 via gearmesh, is attached to a rotary driving source 122 as described below. Differential bevel gear drive system 102 has an input member to output shaft ratio of 1:1.

Input bevel gear 104 transmits the torque/speed at right angles to output bevel gear 106 via spider gear 108. Input and output bevel gears 104, 106 are identical, i.e. they have the same number of teeth, module, and geometry and are mounted symmetrically on their own axis 123 transverse of axis 118 of spider gear 108 and control gear 110. Spur gear 112 is mounted on shaft 126 of output bevel gear 106 and rotates at the same speed as output bevel gear 106. Spur gear 112 further drives spur gear 114, which is rigidly fixed to output shaft 120, through gearmesh. The gear ratio between the spur gears is 1:1. This arrangement allows output shaft 120 to rotate in the same direction and at the same rotational speed as input drive member 116. Alternatively, gears 112 and 114 could be omitted, and the output shaft would rotate in a direction opposite that of the input member. Also, the gear ratios mentioned above are only exemplary. Any gear ratio can be chosen for any of these gears.

When phasing in the advance or retard direction between the input drive member and the output shaft is desired, rotary driving source 122, such as an electric motor, applies torque on control gear 110 depending on the phasing adjustment. Thus, control gear 110 rotates output bevel gear 106 in either advance or retard direction with respect to input bevel gear 104, which ultimately changes the phase of output shaft 120 relative to input shaft 116. The phase adjustment, whether in the advance or retard position, is controlled by an algorithm in an electronic control module (ECM) (not shown). To avoid any backdrive from torque fluctuations in the output shaft, the electric motor should be sized to the maximum required torque. The electric motor may work as a generator in one of the retard or advance directions.

Differential gear system 102 may have straight or spiral bevel gear teeth. Spiral teeth will have two or more teeth in contact at all times, which transmits motion more smoothly and quietly than with straight bevel gears. On the other hand, straight bevel gears are simpler to manufacture and cost less. The gears preferably are of AGMA quality class 8 or 9.

Figure 3:
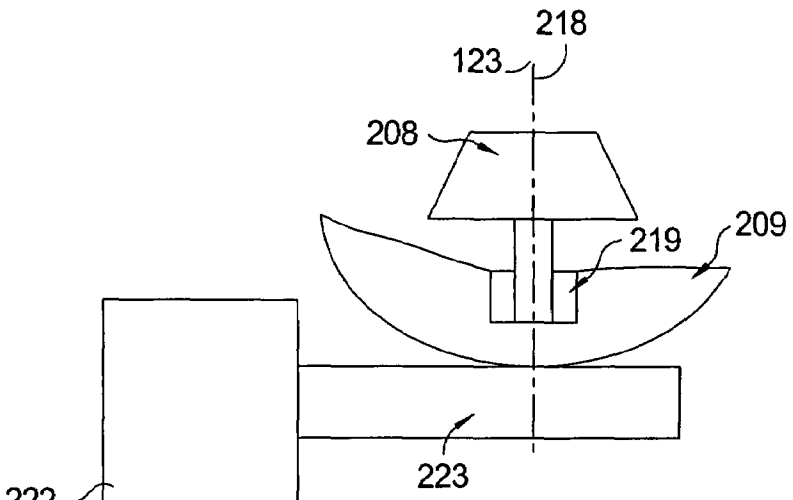
FIG. 3 is a schematic cross-sectional view taken along line 3-3 in FIG. 2.
Figure 2:
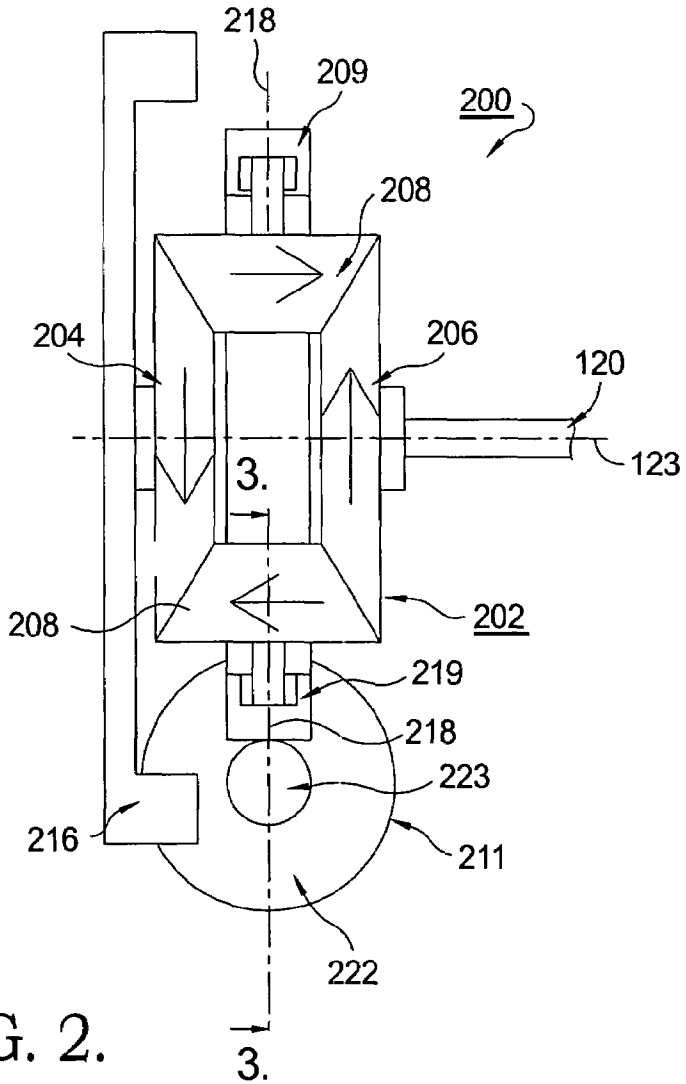
FIG. 2 is a schematic cross-sectional view of a differential bevel gear camshaft phaser in accordance with the invention.

FIGS. 2-3, in accordance with the invention, omit for clarity of presentation the various obvious bearings and housing needed for proper operation of the device, except for spider gear bearings 219. Also not shown for clarity are lubrication conduits.

The present invention described below has the following advantages over a conventional oil driven camshaft phaser:

a) the phaser works independently of the engine oil, and issues such as oil temperature, viscosity, low pressure, and the like are avoided.

b) the phaser is compact, and the overall package can be manufactured within a 130 mm×30 mm envelope.

c) high performance requirements such as high phase rate (250 crank°/sec) and high authority (100 crank°) can be achieved.

Referring to FIGS. 2 and 3, a first embodiment 200 of a camshaft phaser in accordance with the invention includes a differential bevel gear system 202 which differs slightly from system 102. The main components of differential bevel gear system 202 are an input bevel gear 204, an output bevel gear 206, a spider bevel gear or gears 208, a spider gear carrier 209, and control mechanism 211. Input bevel gear 204 is fixed to sprocket 216 for being driven in time with the crankshaft of an internal combustion engine (not shown) and is connected to output bevel gear 206 via spider gears 208. Output bevel gear 206 drives camshaft 120 of the internal combustion engine, directly. Spider gears 208 rotate on their own axes 218 within bearings 219. When the phase angle between the crankshaft and the camshaft is fixed, control mechanism 211 does not rotate, and spider gear carrier 209 is stationary. The sprocket rotation thus drives the camshaft directly via the bevel gears. The differential allows the input torque to be split between the two spider gears 208. This equal load sharing reduces the stress on the teeth.

When the phase angle between the crankshaft and the camshaft needs to be changed, upon the appropriate command from an ECM the control mechanism driving source 222 (an electric motor is proposed in this embodiment, although other forms of rotational activation are embraced by the invention) rotates the spider gear carrier 209 about axis 123 via an optional gear 223. Rotation of motor 222 in one direction will advance the relative phase angle, and rotation of motor 222 in the opposite direction will retard the relative phase angle between the crankshaft and the camshaft.

Referring to FIGS. 2 through 6, in a presently preferred drive embodiment the drive control mechanism consists of a motor 222 driving a worm gear 223. This gearing arrangement is preferred because of the self-locking properties of worm gears, that is, the driving mechanism is not back drivable, under normal conditions. This is a very important design factor because camshaft load torques have very large oscillations, on the order of for instance +/− 12 Nm compared to an average friction torque of 1.0 to 1.5 Nm. These large oscillations of load can cause oscillations of the camshaft position if they not prevented by the self-locking nature of the worm gear.

Figure 5:
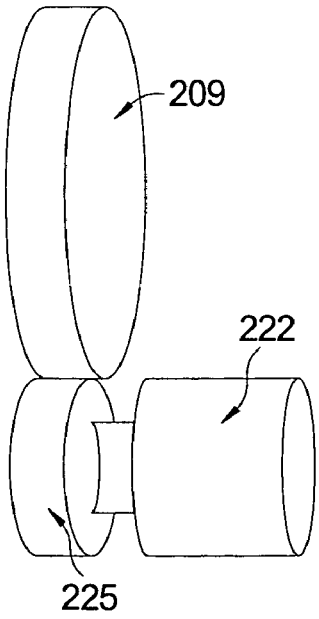
FIG. 5 is a schematic isometric view of a spur gear drive for actuating a camshaft phaser in accordance with the invention.
Figure 6:
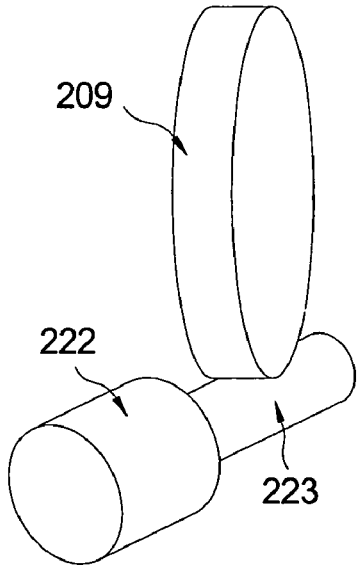
FIG. 6 is a schematic isometric view of a worm gear drive for actuating a camshaft phaser in accordance with the invention.

Other gear types can be envisioned, such as a spur gear 225 as shown in FIG. 5. If a spur gear is used, the system needs to be designed so as to avoid or minimize position oscillations due to camshaft torque variations. One solution consists of using motor 222 to constantly provide a torque to carrier 209, so as to hold it in position. The torque profile and magnitude must be adjusted to provide sufficient resistance to camshaft torque oscillations without inducing motion of spider gear carrier 209.

Figure 4:
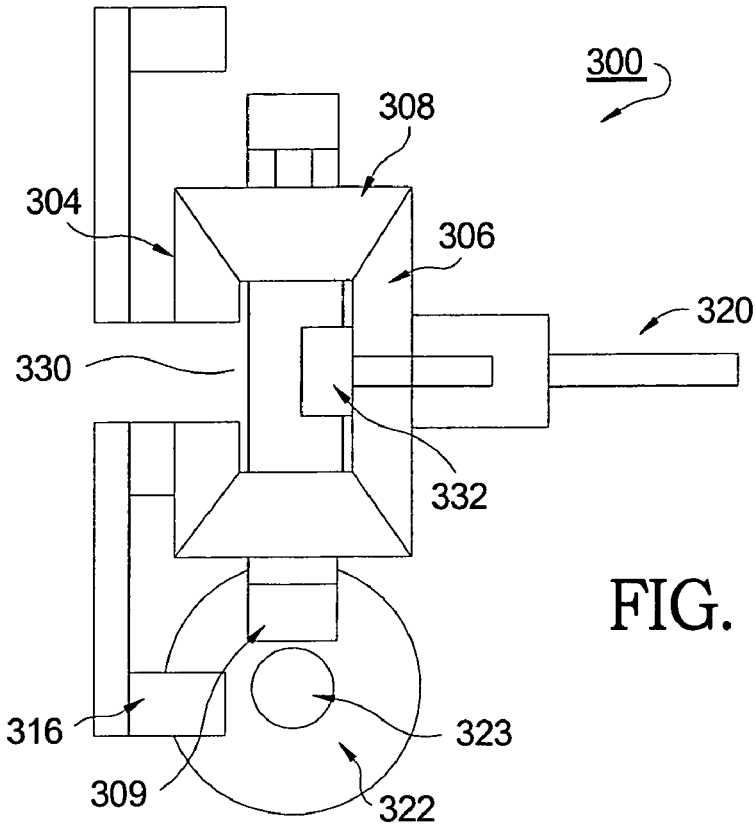
FIG. 4 is a schematic cross-sectional view of another embodiment of a camshaft phaser in accordance with the invention, showing provision for easy bolting of the phaser onto an engine camshaft.

It is desirable for a cam phaser to be preassembled e.g. at the supplier's factory, then assembled as a unit directly onto an engine. This is by far preferable to sending the phaser in two or more subassemblies to the engine plant, and requiring assembly of the various phaser parts to the engine. Referring now to FIG. 4, embodiment 300 lends itself to being pre-assembled. A central bore 330 is created in various components of the phaser, including sprocket 316, input gear 304, and carrier assembly 309, making possible the use of a central bolt 332 to mount phaser 300 via output gear 306 onto camshaft assembly 320. Alternatively, a flanged output gear (not shown) may be slipped over the end of the camshaft and bolted radially thereto.

In most engines, it is desirable for the intake camshaft to be in the full retard position and for the exhaust camshaft to be in the full advance position during engine cranking. It may also be envisioned for some engines that an intermediary position (not quite full retard and/or not quite full advance, respectively) may be preferable, especially for cold starts. The ECM can use motor 222, 322 to drive the system to any desired position before or during engine cranking. Preferably, this is accomplished during engine shut down, although a position adjustment may otherwise be performed just prior to or during cranking proper, for instance, if temperature conditions have changed since engine shut down.

In case of phaser failure, e.g., power failure to the motor, however, there may be a loss of phasing control, that is, the camshaft may be left in whatever phasing position it was when the failure occurred. Depending on what that position is, this could lead to starting difficulties or failure. Of course, if an impeding fault is detected, the phaser could be driven to a desirable fall-back position before the fault is so severe as to make further phasing impossible. However, failures may not always be detected in time. Therefore, a bias spring (not shown) may be included in the mechanism to bias the phaser towards either full retard (intake) or full advance (exhaust).

Figure 7:
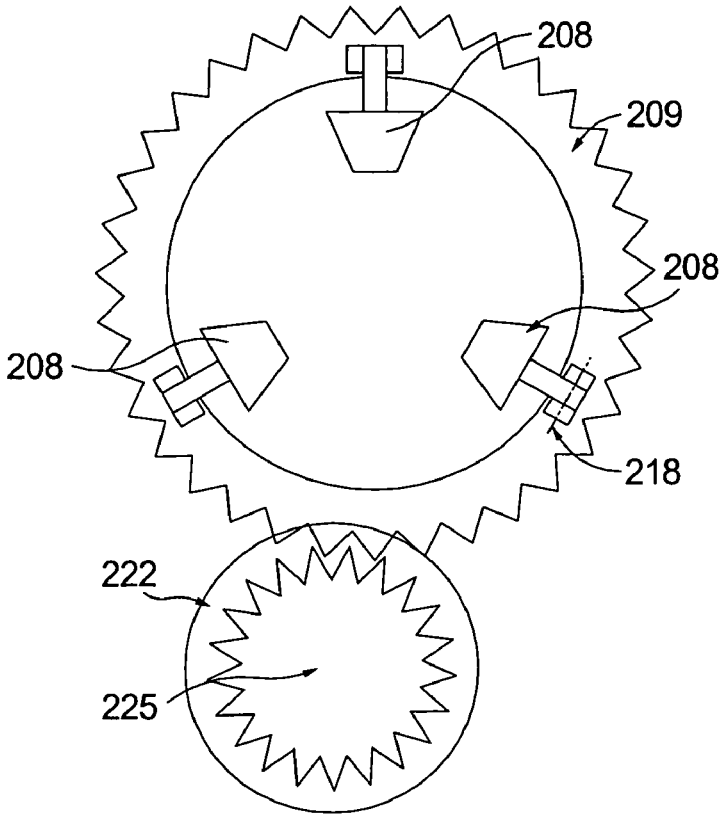
FIG. 7 is a schematic elevational cross-sectional view of an external spur gear drive and full-circle spider gear carrier suitable for use in, for example, the embodiment shown in FIG. 4.
Figure 8:
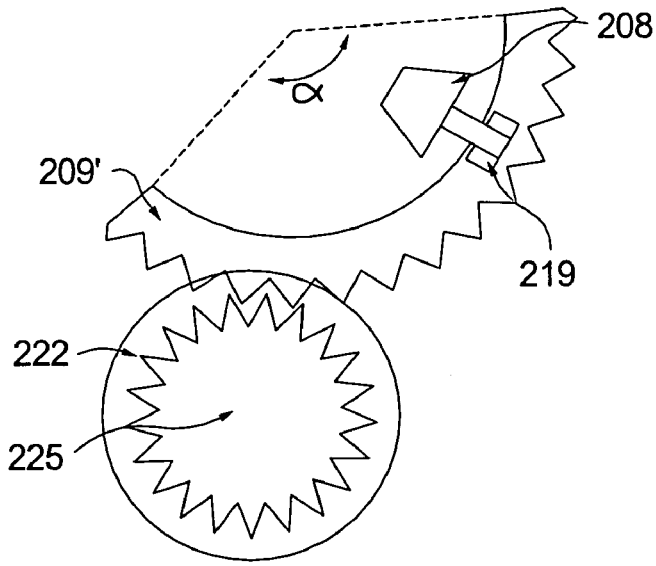
FIG. 8 is a drawing like that shown in FIG. 7, showing that only a limited arc of the spider gear carrier is needed for a single spider gear embodiment.

There must be at least one, and preferably are several, spider gears in the differential bevel gear drive system of the present invention. In a preferred embodiment, there are three spider gears 208 as shown in FIG. 7, disposed symmetrically around a circular (full circle) carrier 209. (Note: FIG. 2 as drawn implies an even number of spider gears; however, this is only for simplicity of drawing and explanation). The advantage of three is balance and symmetry. A larger number of spider gears would be unnecessarily expensive and cumbersome. However, any number of spider gears is possible, including just a single one as shown in FIG. 8. Generally, the load and pitch diameter define the number of spiders. Size is determined by the load bearing capacity of the teeth.

Referring to FIG. 8, in an alternative embodiment, carrier 209' encompasses only a partial circle (arc of span $\alpha$). Such an arrangement is possible because the range of phase shifting is limited (35 cam degrees is typical of current engines, 50 cam degrees is expected in future engines). Therefore, the control mechanism needs to rotate by only the desired range of phase shifting (35°, 50°, etc.). Carrier 209' need therefore encompass only the desired phasing range, plus some tolerance, for a total span $\alpha$ as shown in FIG. 8. However, the configuration of FIG. 7 has the advantage of a more compact packaging and of distributing the load over several symmetrically placed spider gears. Of course, the size of carrier 209 or 209' is not limited to either full circle or span $\alpha$, and other span values in between are possible within the scope of the invention.

Referring now to FIGS. 9 through 12, other arrangements of a differential bevel gear cam phaser in accordance with the invention can be considered. For instance, the spider gears may be mounted on the outer periphery of the carrier ring and extend radially outwards therefrom, instead of on the inside of the carrier ring as shown thus far.

In embodiment 400, spider carrier 409 includes an axial shaft 470 extending through input gear 404 and sprocket 416. A reduction drive gear 472 is mounted on shaft 470 and is driven by a spur gear 425 and motor 422. As the rotational position of carrier 409 is changed by rotation of shaft 470, the phase is changed between input gear 404 and output gear 406, thus changing the phase of camshaft 423.

In embodiment 500, drive motor 522 is mounted directly on the carrier shaft 570 for driving carrier 509. Obviously, direct drive motor 522 has very different characteristics from drive motor 422.

Figure 12:
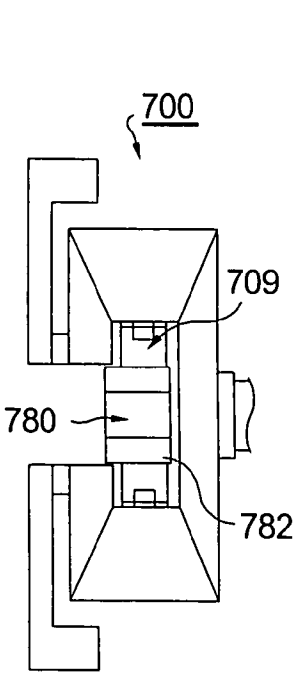
FIGS. 9 through 12 are schematic cross-sectional views of four additional embodiments showing four different exemplary arrangements for driving a spider gear carrier internally of the carrier.
Figure 11:
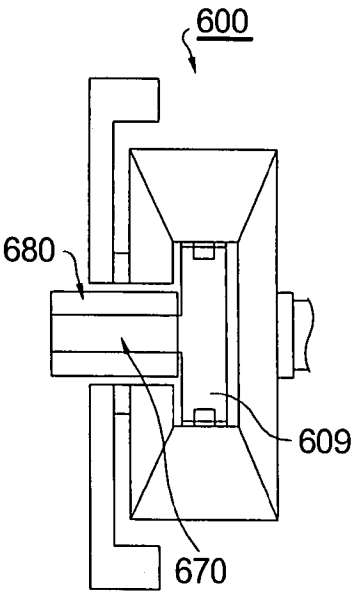
Figure 10:
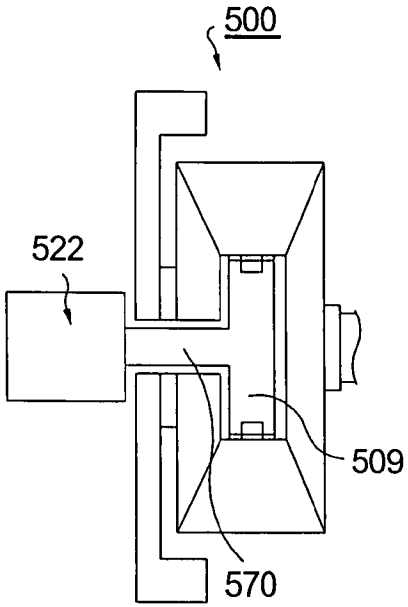
Figure 9:
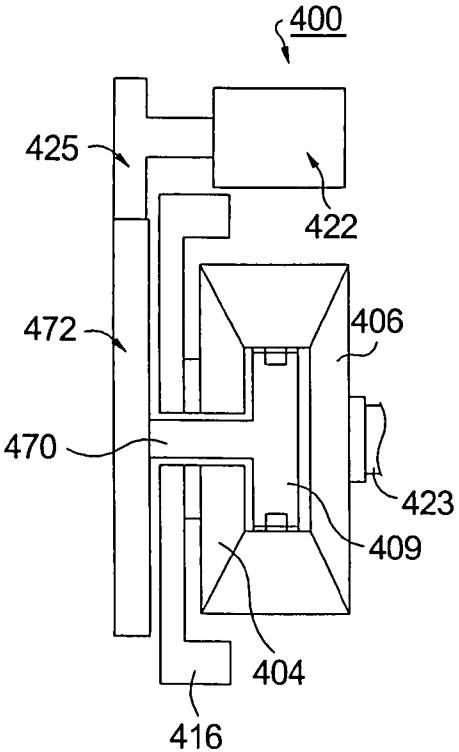

Referring to FIGS. 11 and 12, the drive motor may be recessed within the envelope of the mechanics. In embodiment 600, carrier shaft 670 is actually the motor rotor, surrounded by the motor stator 680. In embodiment 700, an "inside-out" motor configuration is used wherein the carrier shaft is omitted and the motor stator 780 is surrounded by the motor rotor 782 which forms a part of the spider carrier 709.

Figure 13:
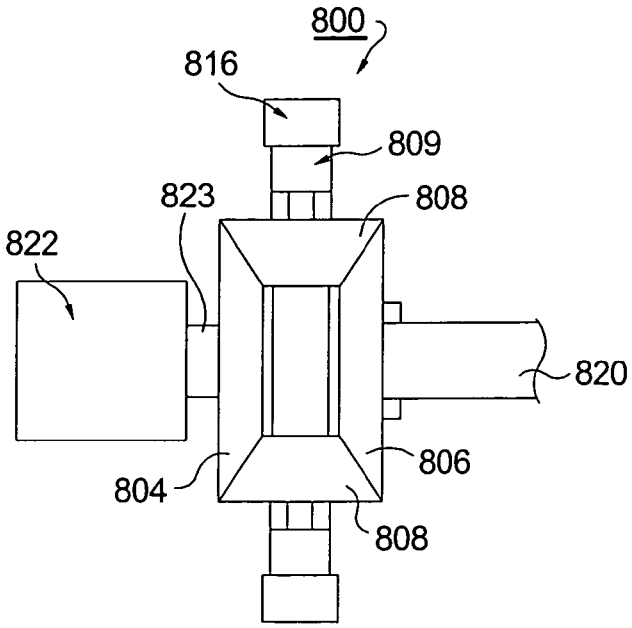
FIG. 13 is a schematic cross-sectional view of an another embodiment showing a sprocket wheel mounted for driving a spider gear carrier directly with a motor for altering the phase of a first ring gear.
Figure 14:
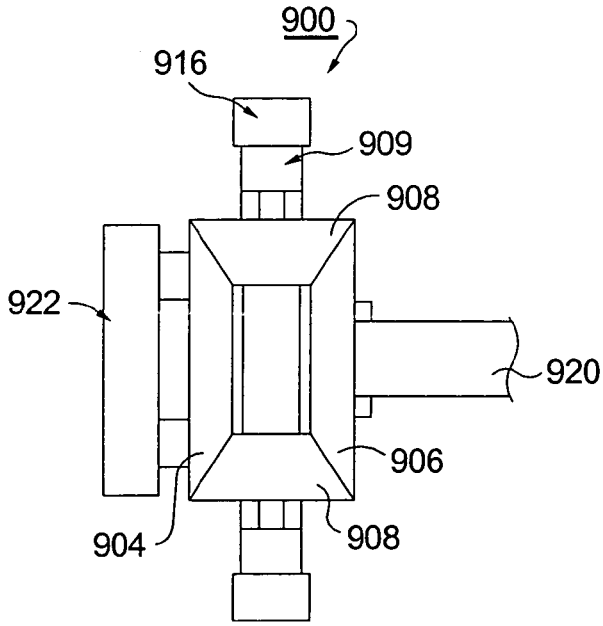
FIG. 14 is a schematic cross-sectional view of yet another embodiment like the embodiment shown in FIG. 13 but having a brake mounted on the first ring gear for altering the phase of the first ring gear.

Referring to FIGS. 13 and 14, another differential gear system arrangement in accordance with the invention consists in having a sprocket drive the spider carrier rather than the first bevel ring gear. Phasing is then achieved by adjusting the rotational position of the first bevel ring gear.

In embodiment 800, a motor 822 mounted onto first bevel ring gear 804 (defining thereby gear 804 as a control gear for this embodiment) acts as a brake on shaft 823 in balancing camshaft friction during operation with constant camshaft angular position (no phasing). The spiders do not spin on their axes and the entire assembly 800 (that is, shaft 823, control gear 804, output gear 806, spider gears 808, gear carrier 809) all rotate together at the same speed, driven by sprocket 816. When phasing is desired, the motor torque on shaft 823 is either decreased or increased thus causing rotation of spider gears 808 either clockwise or counterclockwise.

Another operating mode for embodiment 800 consists in having motor 822 hold control gear 804 steady during operation with constant camshaft angular position. In this mode, spider gears 808 spin on their axes and transfer the drive torque to output gear 806 and camshaft 820. Phasing is achieved by rotating shaft 823 of the motor 822 in either direction.

Referring to FIG. 14, in embodiment 900, motor 822 is replaced by a spring/brake system 922 mounted on control gear 904. In this alternative, a torsional spring rotates the system in one direction, and a brake acts against the spring. By adjusting the brake torque, various phaser positions can be achieved. The brake is preferably electromagnetic, and preferably of the hysteresis type. Brakes, especially their controllers, are less expensive than motors and motor controllers, but brake torque can be applied only to slow the motion of a rotating body, and cannot accelerate it. In some configurations, the camshaft friction may be sufficient to counterbalance the brake torque, and the torsional spring can be less stiff or even omitted altogether. In such a configuration, when the phaser is not adjusting the camshaft phasing, the brake torque (like the motor torque in embodiment 800) is set at a level equal to the camshaft friction torque, so that spider gears 908 do not spin on their axes. The entire assembly 900 (that is, control gear 904, output gear 906, spider gears 908, gear carrier 909) all rotate together at the same speed, driven by sprocket 916. When phasing is desired, the brake torque on control gear 904 is either decreased or increased thus causing rotation of spider gears 908 either clockwise or counterclockwise.

An aspect of the invention includes the use of a differential bevel gear with an input gear, an output gear, and spider gears and carrier. The engine sprocket, the camshaft, and the controlling elements (motor, spring and brake, etc.) are each operationally connected to one or the other of the differential bevel gears. It is understood that there are various permutations possible concerning which gear or carrier is connected to the sprocket, camshaft, and controlling element, all embodying the general principles of the present invention.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A camshaft phaser for controllably varying the phase relationship between a crankshaft and a camshaft in an internal combustion engine, comprising a differential bevel gear system having first and second bevel ring gears spaced apart along a first and common rotational axis, and having at least one spider bevel gear rotatable about a second axis orthogonal to said first axis and being meshed with said first and second bevel ring gears to transmit torque therebetween, wherein said second bevel ring gear is an output gear for driving said camshaft, further comprising:

a) a sprocket mounted on said first bevel ring gear and drivable by said crankshaft;

b) a control gear disposed in meshed relationship with said first and second bevel ring gears; and c) a rotary actuator attached to said control gear for controllably rotating said control gear to change the phase relationship between said first and second bevel ring gears.

2. A camshaft phaser for controllably varying the phase relationship between a crankshaft and a camshaft man internal combustion engine, comprising a differential bevel gear system having first and second bevel ring gears spaced apart along a first and common rotational axis, and having at least one spider bevel gear rotatable about a second axis orthogonal to said first axis and being meshed with said first and second bevel ring gears to transmit torque therebetween, further comprising an arcuate spider gear carrier for supporting said spider bevel gear and for changing the angular position of said spider bevel gear with respect to said first and second bevel ring gears to change the phase relationship between said first and second bevel ring gears, wherein said second bevel ring gear is an output gear for driving said camshaft.

3. A camshaft phaser in accordance with claim 2 wherein the shape of said arcuate spider gear carrier is selected from the group consisting of full circle and partial circle.

4. A camshaft phaser in accordance with claim 2 wherein a rotary actuator controllably rotates said arcuate spider gear carrier about said first axis to change the phase relationship between said first and second bevel ring gears.

5. A camshaft phaser in accordance with claim 4 further comprising a sprocket mounted on said first bevel ring gear and drivable by said crankshaft.

6. A camshaft phaser in accordance with claim 5 wherein said arcuate spider gear carrier is a ring gear having gear teeth along an outer surface thereof, and wherein said spider gear is disposed within said ring gear, and wherein said rotary actuator comprises an electric motor and a drive gear for engaging said gear teeth on said outer surface.

7. A camshaft phaser in accordance with claim 6 wherein said drive gear is selected from the group consisting of a spur gear and a worm gear.

8. A camshaft phaser in accordance with claim 5 wherein said arcuate spider gear carrier includes an axial shaft, and wherein said spider gear is disposed outwardly of said carrier, and wherein said rotary actuator comprises an electric motor for driving said axial shaft.

9. A camshaft phaser in accordance with claim 5 wherein said spider gear is disposed outwardly of said carrier, and wherein said rotary actuator comprises an electric motor disposed within said carrier.

10. A camshaft phaser in accordance with claim 9 wherein said motor includes a rotor and a stator and wherein said rotor is attached to said carrier.

11. A camshaft phaser in accordance with claim 10 wherein said rotor is disposed within said stator.

12. A camshaft phaser in accordance wit claim 10 wherein said stator is disposed within said rotor.

13. A camshaft phaser in accordance with claim 2 comprising:

a) a sprocket formed on the outer surface of said arcuate spider gear carrier for being driven by said crankshaft; and b) a controller attached to said first ring gear for controlling the phase of said arcuate spider gear carrier with respect to said second ring gear.

14. A camshaft phaser in accordance with claim 13 wherein said controller is selected from the group consisting of an electric motor and a brake.

15. A camshaft phaser for controllably varying the phase relationship between a crankshaft and a camshaft in an internal combustion engine, comprising a differential bevel gear system having first and second bevel ring gears spaced apart along a first and common rotational axis, and having at least one spider bevel gear rotatable about a second axis orthogonal to said first axis and being meshed with said first and second bevel ring gears to transmit torque therebetween, and having a control gear disposed in meshed relationship with said first and second bevel ring gears, and having an actuator attached to said control gear for controllably rotating said control gear to change the phase relationship between said first and second bevel ring gears, wherein said second bevel ring gear is an output gear for driving said camshaft wherein said first bevel ring gear is drivable by said crankshaft.

* * * * *